US009768004B2

(12) United States Patent
Fogwill et al.

(10) Patent No.: US 9,768,004 B2
(45) Date of Patent: Sep. 19, 2017

(54) SYSTEMS, DEVICES, AND METHODS FOR CONNECTING A CHROMATOGRAPHY SYSTEM TO A MASS SPECTROMETER

(71) Applicant: Waters Technologies Corporation, Milford, MA (US)

(72) Inventors: Michael O. Fogwill, South Grafton, MA (US); Joseph D. Michienzi, Plainville, MA (US); James P. Murphy, Franklin, MA (US); Geoff C. Gerhardt, Woonsocket, RI (US)

(73) Assignee: Waters Technologies Corporation, Milford, MA (US)

( * ) Notice: Subject to any disclaimer, the term of this patent is extended or adjusted under 35 U.S.C. 154(b) by 222 days.

(21) Appl. No.: 14/552,872

(22) Filed: Nov. 25, 2014

(65) Prior Publication Data

US 2015/0144782 A1 May 28, 2015

Related U.S. Application Data

(60) Provisional application No. 61/908,857, filed on Nov. 26, 2013.

(51) Int. Cl.
*H01J 49/00* (2006.01)
*H01J 49/10* (2006.01)
*H01J 49/04* (2006.01)

(52) U.S. Cl.
CPC ..... *H01J 49/10* (2013.01); *H01J 49/0431* (2013.01); *Y10T 29/5313* (2015.01)

(58) Field of Classification Search
CPC .... H01J 49/10; H01J 49/0431; Y10T 29/5313
(Continued)

(56) References Cited

U.S. PATENT DOCUMENTS 4,005,291 A * 1/1977 Arsenault ..... H01J 49/10 250/282
6,586,731 B1 * 7/2003 Jolliffe ..... H01J 49/049 250/281

(Continued)

FOREIGN PATENT DOCUMENTS

CA WO 2009094780 A1 * 8/2009 ..... H01J 49/10
GB 2358924 A 8/2001

(Continued)

OTHER PUBLICATIONS

Search and Examination Report for United Kingdom Patent Application No. 1420981.1, issued Jul. 3, 2015 (9 pages).

*Primary Examiner* — Michael Maskell
(74) *Attorney, Agent, or Firm* — Waters Technologies Corporation

(57) ABSTRACT

The invention provides interfaces between analytical instruments, e.g., between chromatography systems and mass spectrometers. In an exemplary embodiment, an ion source is provided for connecting a carbon dioxide-based chromatograph device to a mass spectrometer. The ion source includes a first conduit for receiving eluent from the chromatography device, a heater for heating at least a portion of said first conduit, a second conduit in fluid communication with the first conduit, an inlet for receiving eluent from said second conduit and introducing the eluent into an ion source region to form a plume of gas and/or liquid in the ion source region, and an ionization promoting inlet for injecting an ionization promoting fluid into the ion source region to interact with the plume to promote ionization of at least some of the plume.

34 Claims, 6 Drawing Sheets

(58) Field of Classification Search
USPC ..... 250/281, 282, 288
See application file for complete search history.

(56) References Cited

U.S. PATENT DOCUMENTS

| | | | | |
|---|---|---|---|---|
| 7,132,650 | B1 * | 11/2006 | Gamble | G01N 30/7233 137/625.46 |
| 7,411,186 | B2 * | 8/2008 | Mordehai | H01J 49/107 250/281 |
| 2002/0182128 | A1 * | 12/2002 | Carnahan | B01J 19/0046 422/600 |
| 2010/0171033 | A1 * | 7/2010 | Jolliffe | H01J 49/10 250/282 |
| 2011/0113866 | A1 * | 5/2011 | Finlay | G01N 30/6095 73/61.52 |
| 2011/0266433 | A1 * | 11/2011 | Jarrell | G01N 30/7206 250/282 |
| 2012/0104248 | A1 * | 5/2012 | Hardman | H01J 49/165 250/288 |
| 2013/0068946 | A1 * | 3/2013 | Moskovets | G01N 30/7233 250/288 |
| 2013/0306853 | A1 * | 11/2013 | Eastwood | H01J 49/0036 250/282 |
| 2014/0151547 | A1 * | 6/2014 | Bajic | H01J 49/0445 250/282 |
| 2016/0018366 | A1 | 1/2016 | Fogwill et al. | |
| 2016/0018367 | A1 | 1/2016 | Fogwill et al. | |

FOREIGN PATENT DOCUMENTS

| | | | |
|---|---|---|---|
| WO | 2007/002141 | A2 | 1/2007 |
| WO | 2009/094780 | A1 | 8/2009 |

* cited by examiner

SYSTEMS, DEVICES, AND METHODS FOR CONNECTING A CHROMATOGRAPHY SYSTEM TO A MASS SPECTROMETER

CROSS-REFERENCE TO RELATED APPLICATION

This application claims priority to and benefit of U.S. Provisional Application No. 61/908,857 filed Nov. 26, 2013, the contents and teachings of which are incorporated herein by reference in their entirety.

FIELD OF THE INVENTION

This invention relates generally to interfaces between analytical instruments, and more specifically, although not exclusively to interfaces between chromatography systems and Mass Spectrometers.

BACKGROUND

Often it may be useful to separate different compounds in a mixed sample. In order to do so, an analytical chemist may use chromatography. There are several different types of chromatography, which may be preferred for different types of samples. Some of these types of chromatography include carbon dioxide as the mobile phase. One example of these types of chromatography is Supercritical Fluid Chromatography (SFC).

Frequently, after a separation performed by chromatography, the separated analytes need further analysis by a mass spectrometer, to give structural information about the analytes. However, several types of chromatography systems, including SFC systems, operate at high pressures and high temperatures, which can make the eluent difficult to efficiently interface with mass spectrometers, or other analytical instruments for further analysis. The high pressure is often maintained by a back pressure regulator (BPR). However, introducing the mobile phase flow to the mass spectrometer after passing through a BPR is ill-advised since the volume of the back pressure regulator can lead to a reduction in the chromatographic efficiency (i.e. lead to a reduction in the sharpness of the chromatographic peaks). Further, since there is no appreciable mobile phase density after exiting the BPR and because analyte solubility is directly related to mobile phase density, analyte transport to the mass spectrometer becomes problematic. Also, BPRs are not effective when operating with the low mobile phase flow rates encountered with microfluidic chromatography applications.

A further problem to interfacing SFC, and some other chromatography systems, to mass spectrometers is where the mobile phase in the chromatography is carbon dioxide. When only carbon dioxide comprises the mobile phase, analytes present are not easily ionized in the electrospray ion source of a mass spectrometer. Often, this is solved by adding a make-up fluid (i.e. methanol) to the mobile phase downstream of the column before it is introduced to the mass spectrometer. This involves more plumbing, which may also lead to the sharpness of the peaks from the chromatography system to be reduced, and can create extra cost to the instrument (i.e. require an additional high-pressure pump).

There is, therefore, a need for an improved interface between a carbon dioxide based chromatography device and a mass spectrometer. There is also a need for an alternative apparatus for interfacing a carbon-dioxide based chromatography device and a mass spectrometer that overcomes or at least mitigates the problems associated with the prior art apparatus and systems.

SUMMARY

A first aspect of the invention provides an ion source for connecting a carbon dioxide based chromatography device to a mass spectrometer. In an exemplary embodiment, the ion source includes a first conduit for receiving eluent from the chromatography device, a heater for heating at least a portion of said first conduit, a second conduit in fluid communication with the first conduit, an inlet for receiving eluent from the second conduit and introducing the eluent into an ion source region to form a plume of gas and/or liquid in the ion source region, and an ionization promoting inlet for injecting an ionization promoting fluid into the ion source region to interact with the plume to promote ionization of at least some of the plume. In some embodiments, the first conduit can have a first diameter and the second conduit can have a smaller diameter than the first diameter of the first conduit along at least a portion of a length of the second conduit.

The apparatus according to the invention has the advantage of linking the chromatography device with the ion source without the need for plumbing connections, which may impair the separation provided by the chromatography. Furthermore, the apparatus may be cheaper to produce, due to the reduction in the elements being manufactured.

In some embodiments the chromatography device may be a carbon dioxide based device that uses carbon dioxide as a component of the mobile phase. An example of a carbon dioxide based chromatography device is a supercritical fluid chromatography system designed to use $CO_2$ in the mobile phase flow stream.

In an exemplary embodiment the ion source can be an electrospray ion source. For example, the ionization promoting inlet may be concentric to the inlet needle.

In another exemplary embodiment the ion source can be an impactor spray ion source. For example, the impactor spray ion source can have an impactor and the ionization promoting inlet can be a hole disposed on the impactor. In a further embodiment the ion source can be an APCI ion source.

In any of the embodiments described herein, the second conduit can be a conduit of constant diameter or a tapered conduit.

In some embodiments, the second conduit can include a fritted restrictor, a converging-diverging restrictor, and/or an integral restrictor.

In some embodiments, the ionization promoting inlet can be adapted to facilitate the ionization promoting fluid containing methanol.

In an exemplary embodiment, the ionization promoting inlet can be adapted to facilitate the ionization promoting fluid containing a liquid selected from the group consisting of acetonitrile, isopropanol, ethanol, methanolic ammonia, methanolic hydrochloric acid, tetrahydrofuran, alkanes (e.g. hexane, heptane, etc.) and, chlorinated solvents (e.g. chloroform, chloromethane, dichloromethane etc.).

In some embodiments, a temperature sensor and feedback mechanism for regulating the temperature of the eluent passing from the carbon-dioxide based chromatography device into the ion source region can be provided.

In some embodiments, a pressure sensor and feedback mechanism for regulating the pressure of the eluent passing from the carbon-dioxide based chromatography device into the ion source region can be provided.

In exemplary embodiments, the ion source does not require a make up flow. In embodiments using a make up flow, the make up flow would be introduced after the carbon-dioxide based chromatography device but before the ion source of the mass spectrometer.

Another aspect can provide a mass spectrometer incorporating an ion source as described above.

A further aspect can provide a retrofit kit for adapting a mass spectrometer incorporating an ion source as described above.

Some aspects provide a carbon-dioxide based chromatography device and a mass spectrometer incorporating an ion source as described above.

Some aspects of the present invention provide a retrofit kit for connecting a carbon-dioxide based chromatography device and a mass spectrometer incorporating an ion source as described above.

One aspect provides a method of ionization of an eluent using an apparatus as described above.

A further aspect of the invention provides a method of connecting a carbon-dioxide based chromatography device to a mass spectrometer and ionizing analytes of interest with an eluent. In an exemplary embodiment, the method includes eluent providing a first conduit for receiving eluent from carbon-dioxide based chromatography device, heating at least a portion of said first conduit, providing a second conduit in fluid connection to the first conduit, injecting the eluent from an inlet into an ion source region to form a plume of gas and/or liquid in the ion source region, and injecting an ionization promoting fluid into the ion source region to interact with the plume of gas and/or liquid to produce enhanced ionization of at least some of the plume of gas and/or liquid. In some embodiments, the first conduit can have a first diameter and the second conduit can have a smaller diameter than the first diameter of the first conduit along at least a portion of the length of the second conduit.

In some embodiments, a temperature sensor can be provided to measure the temperature of the eluent in the first conduit or the second conduit. A controller may be arranged to include a feed back mechanism which adjusts the temperature of the eluent according to the temperature measured by the temperature sensor to optimise ionization. In some embodiments, a pressure sensor can be provided to measure the pressure of the eluent in the first conduit or the second conduit. A controller may be arranged to include a feed back mechanism which adjusts the pressure of the eluent according to the pressure measured by the pressure sensor to optimise ionization. For example, a temperature controller can optionally be in communication with the temperature sensor to determine the current temperature of the eluent in the first or second conduit and, if necessary, adjust the temperature applied to the heated region in order to attain a target pressure. A predetermined mapping of temperature to pressure, can be used to determine the necessary temperature adjustment. In another embodiment, the temperature controller can include an active feedback loop with a pressure sensor disposed in the fluidic path for closed-loop control. For example, the temperature and/or pressure can be controlled as discussed in U.S. Provisional Patent Application No. 61/777,065, filed Mar. 12, 2013, which is incorporated by reference herein in its entirety.

In some exemplary embodiments, a makeup fluid can be pre-mixed with the column eluent prior to the fluid entering the mass spectrometer's ion source. In contrast, the ionization promoting fluid discussed herein is not pre-mixed with the eluent. Instead, in exemplary embodiments, the ionization promoting fluid can be added separately within or upon entry of the eluent into the ion source region.

The aspects and embodiments discussed herein provide numerous benefits. For example, the complexity and detrimental effects on separation efficiency of a makeup flow pump can be eliminated. For example, with some systems, a 30% loss in efficiency can be seen due to the makeup flow addition and split-flow interface. For another example, the addition of an ionization promoting fluid allows for effective ionization at low modifier percentages (i.e. under 5% modifier). In such situations, there is little to no liquid modifier present to form droplets in ESI. If no droplets are produced, then no ions can be produced. The addition of an ionization promoting fluid, as discussed herein, allows for effective ionization at these low modifier percentages. For a further example, full-flow introduction (i.e. no splitting of eluent) of the mobile phase to the mass spectrometer can be provided. Full-flow introduction of mobile phase to the mass spectrometer can result in lower limits of detection and eliminate split ratio inconsistencies when system parameters (i.e. BPR pressure, mobile phase composition, etc.) are changed. However, embodiments discussed herein are not limited to a full-flow interface and can still function in a split-flow situation.

Systems that use make up flow require a high pressure pump to introduce the makeup fluid downstream of the column but upstream of the pressure control (i.e. BPR). Embodiments disclosed herein use a low pressure pump to introduce the ionization promoting fluid into the atmospheric pressure ion source. Low pressure pumps are of relatively low cost in comparison to the high pressure pump required in other methods.

As used herein, the term "a plume of gas and/or liquid" refers to the eluent that may be injected into the ion source region. This is because the exact make up of the eluent may change what happens in the ion source. Upstream of the pressure control (i.e. BPR or pressure restrictor), the mobile phase (e.g. $CO_2$ with or without modifier) is in its dense state. The analytes are only dissolved in the mobile phase when the eluent is in its dense state. When the eluent decompresses through the restrictor the decompressed eluent still carries the analytes. In the case of a neat $CO_2$ mobile phase (i.e. without any modifier) the eluent is carrying liquid/solid analyte particles (an aerosol). In the case of a mobile phase comprising $CO_2$ with a modifier added to it, the eluent is carrying droplets of modifier containing analytes.

A plume of droplets and gas is introduced into the ion region in the case of modified $CO_2$. The analytes of interest are likely within the droplets of liquid modifier within the plume. In contrast, the plume would likely be an aerosol of liquid/solid analyte particles in the case of neat $CO_2$.

BRIEF DESCRIPTION OF THE DRAWINGS

The present invention will now be described by way of example only, and not in any limitative sense with reference to the accompanying drawings in which.

DETAILED DESCRIPTION

Figure 1:
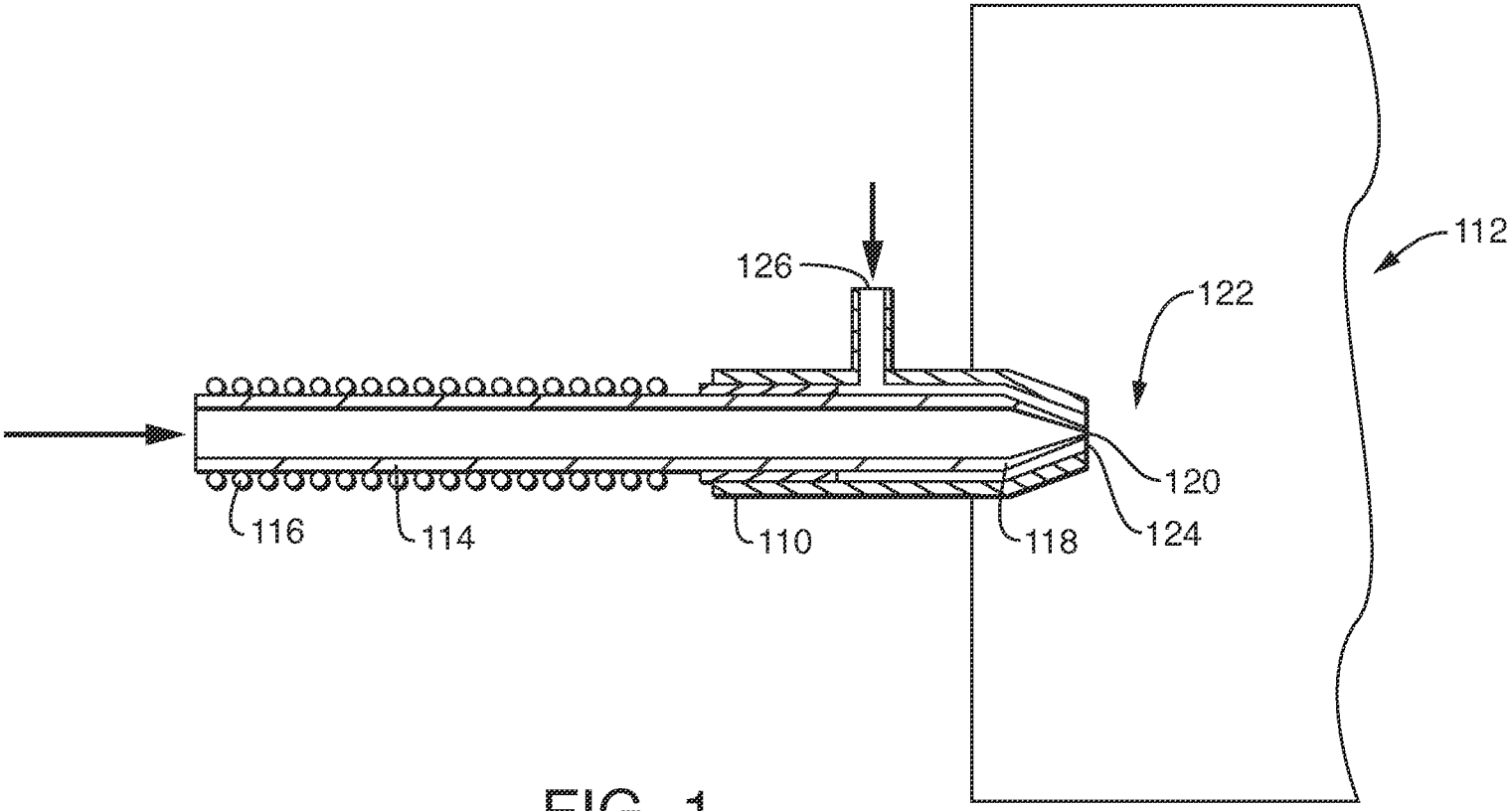
FIG. 1 is a schematic illustration of an apparatus in a first mode according to the invention.

FIG. 1 is a schematic illustration of an apparatus in accordance with a first embodiment of the invention. In this embodiment, a supply mechanism (110) from a carbon-dioxide based chromatography device (not shown) to an ion source (112) is provided. A first conduit (114) for receiving eluent from the a carbon-dioxide based chromatography device (not shown) is provided. The conduit has a heating element (116) for heating the first conduit section. A second conduit section is also provided (118), where the diameter of the second conduit section is smaller than the diameter of the first conduit section in at least one position. For example, the second conduit can be of a smaller diameter than the first diameter of the first conduit along at least a portion of a length of the second conduit. The portion of the second conduit having a smaller diameter can be disposed at or near a terminal end of the second conduit or along the length of the conduit. In exemplary embodiments, the second conduit can have a tapered portion, a converging-diverging portion, or other reduced-diameter portion.

Following the second conduit system, an inlet (120) is provided for receiving eluent from the second conduit section (118) and spraying the eluent from the inlet (120) into an ion source region (122) to form a plume of gas and/or liquid in the ion source region (122). An electrode (not shown) is also provided on the inlet (120) to produce ionization. An ionization promoting inlet (124) suitable for injecting an ionization promoting fluid into the ion source is also provided. In this embodiment, the ionization promoting inlet (124) is a concentric inlet around the inlet (120). The ionization promoting fluid may be arranged to flow into the inlet through an aperture (126). The ionization promoting fluid is arranged to enter the ion source region (122) to interact with the plume of gas and/or liquid to produce enhanced ionization of the eluent.

Figure 2:
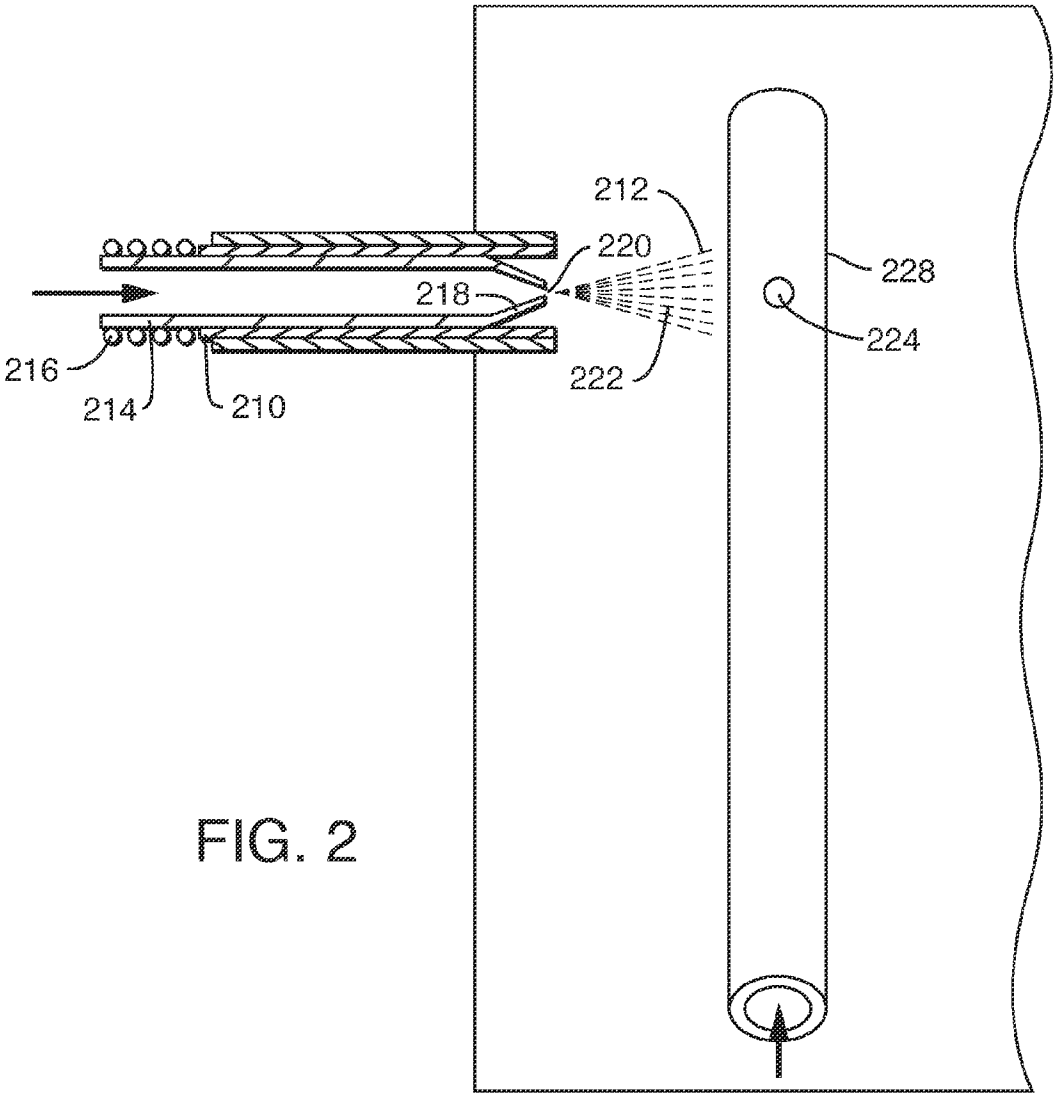
FIG. 2 is a schematic illustration of an apparatus in a second embodiment of the invention.

FIG. 2 is a schematic illustration of an apparatus in accordance with a second embodiment of the invention. In this embodiment, a supply mechanism (210) from a carbon-dioxide based chromatography device (not shown) to an ion source (212) is provided. A first conduit (214) for receiving eluent from the carbon-dioxide based chromatography device (not shown) is provided. The conduit has a heating element (216) for heating the first conduit section. A second conduit section is also provided (218), where the diameter of the second conduit section is smaller than the diameter of the first conduit section in at least one position. For example, the second conduit can be of a smaller diameter than the first diameter of the first conduit along at least a portion of a length of the second conduit. The portion of the second conduit having a smaller diameter can be disposed at or near a terminal end of the second conduit or along the length of the conduit. In exemplary embodiments, the second conduit can have a tapered portion, a converging-diverging portion, or other reduced-diameter portion.

Following the second conduit system, an inlet (220) is provided for receiving eluent from the second conduit section (218) and spraying the eluent from the inlet (220) into an ion source region (222) to form a plume of gas and/or liquid in the ion source region (222). Within the ion source region (222), an impactor (228) is arranged within the path of travel of the plume of gas and/or liquid. An ionization promoting inlet (224) suitable for injecting an ionization promoting fluid into the ion source is also provided. In this embodiment, the ionization promoting inlet (224) is provided upon the impactor, such that the impactor is a hollow tube and a flow of the ionization enhancing fluid is arranged through the hollow impactor tube, and onto the outer, target surface of the impactor (228). The ionization promoting fluid is arranged to coat the target surface of the impactor (228) in the ion source region (222). This will lead to the ionization promoting fluid to interact with the plume of gas and/or liquid to produce enhanced ionization of the eluent.

Figure 3:
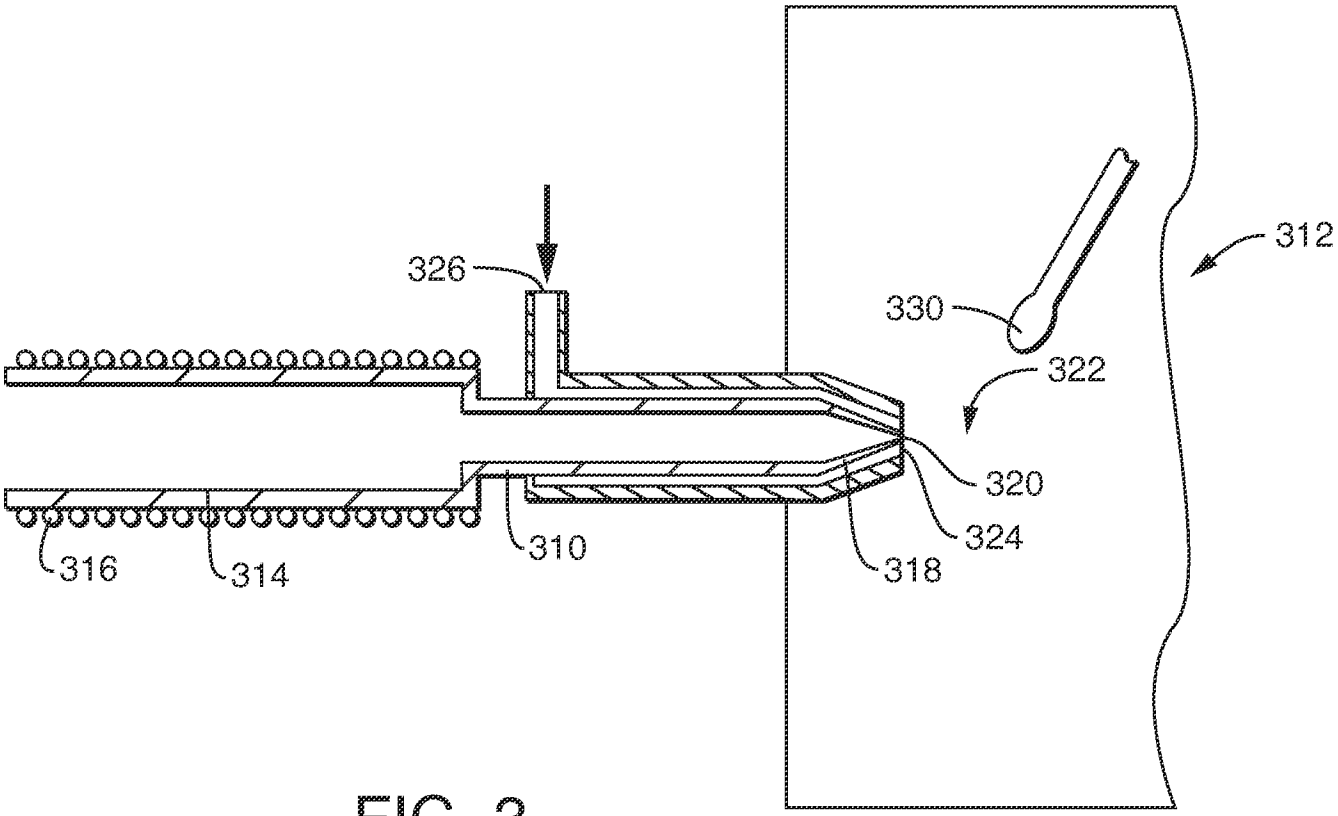
FIG. 3 is a schematic illustration of an apparatus in a third embodiment of the invention.

FIG. 3 is a schematic illustration of an apparatus in accordance with a third embodiment of the invention. In this embodiment, a supply mechanism (310) from a carbon-dioxide based chromatography device (not shown) to an ion source (312) is provided. A first conduit (314) for receiving eluent from the carbon-dioxide based chromatography device (not shown) is provided. The conduit has a heating element (316) for heating the first conduit section. A second conduit section is also provided (318), where the diameter of the second conduit section is smaller than the diameter of the first conduit section in at least one position. For example, the second conduit can be of a smaller diameter than the first diameter of the first conduit along at least a portion of a length of the second conduit. The portion of the second conduit having a smaller diameter can be disposed at or near a terminal end of the second conduit or along the length of the conduit. In exemplary embodiments, the second conduit can have a tapered portion, a converging-diverging portion, or other reduced-diameter portion.

Following the second conduit system, an inlet (320) is provided for receiving eluent from the second conduit section (318) and spraying the eluent from the inlet (320) into an ion source region (322) to form a plume of gas and/or liquid in the ion source region (322). An ionization promoting inlet (324) suitable for injecting an ionization promoting fluid into the ion source is also provided. In this embodiment, the ionization promoting inlet (324) is a concentric inlet around the inlet (320). The ionization promoting fluid may be arranged to flow into the inlet through an aperture (326). Within the ion source region (322), a corona pin (330) is arranged within the path of travel of the plume of gas and/or liquid and the ionization promoting fluid. This will lead to the ionization promoting fluid to interact with the plume of gas and/or liquid to produce enhanced ionization of the eluent, upon interaction with the corona pin (330) by the plume of gas and/or liquid and the ionization promoting fluid.

Figure 4:
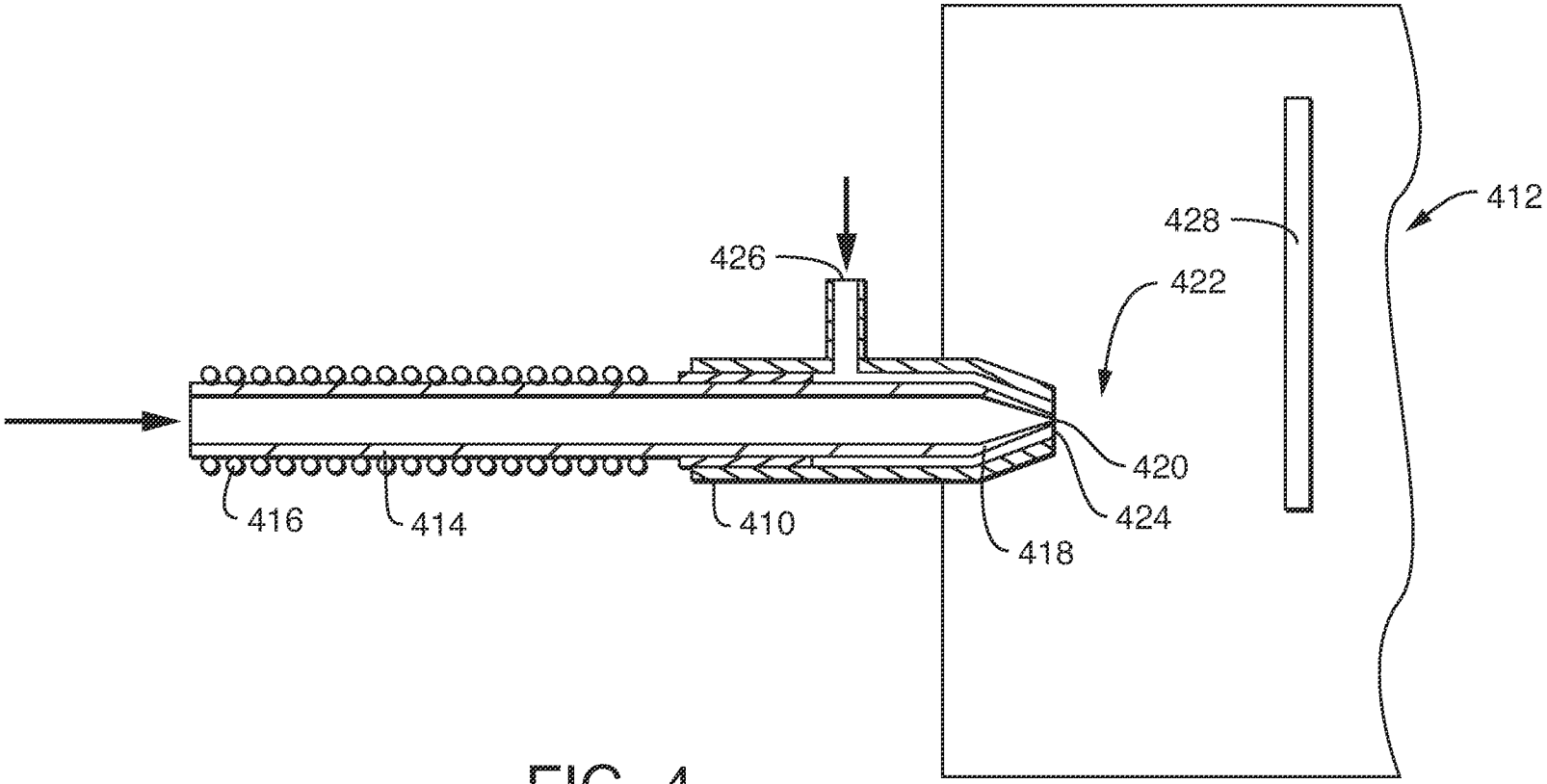
FIG. 4 is a schematic illustration of an apparatus in a fourth embodiment of the invention.

FIG. 4 is a schematic illustration of an apparatus in accordance with a fourth embodiment of the invention. In this embodiment, a supply mechanism (410) from a carbon-dioxide based chromatography device (not shown) to an ion source (412) is provided. A first conduit (414) for receiving eluent from the carbon-dioxide based chromatography device (not shown) is provided. The conduit has a heating element (416) for heating the first conduit section. A second conduit section is also provided (418), where the diameter of the second conduit section is smaller than the diameter of the first conduit section in at least one position. For example, the second conduit can be of a smaller diameter than the first diameter of the first conduit along at least a portion of a length of the second conduit. The portion of the second conduit having a smaller diameter can be disposed at or near a terminal end of the second conduit or along the length of the conduit. In exemplary embodiments, the second conduit can have a tapered portion, a converging-diverging portion, or other reduced-diameter portion.

Following the second conduit system, an inlet (420) is provided for receiving eluent from the second conduit section (418) and spraying the eluent from the inlet (420) into an ion source region (422) to form a plume of gas and/or liquid in the ion source region (422). An ionization promoting inlet (424) suitable for injecting an ionization promoting fluid into the ion source is also provided. In this embodiment, the ionization promoting inlet (424) is a concentric inlet around the inlet (420). The ionization promoting fluid may be arranged to flow into the inlet through an aperture (426). Within the ion source region (422), an impactor (428) is arranged within the path of travel of the plume of gas and/or liquid and the ionization promoting fluid. This will lead to the ionization promoting fluid to interact with the plume of gas and/or liquid to produce enhanced ionization of the eluent, upon contact with the impactor (428) by the plume of gas and/or liquid and the ionization promoting fluid.

Figure 5:
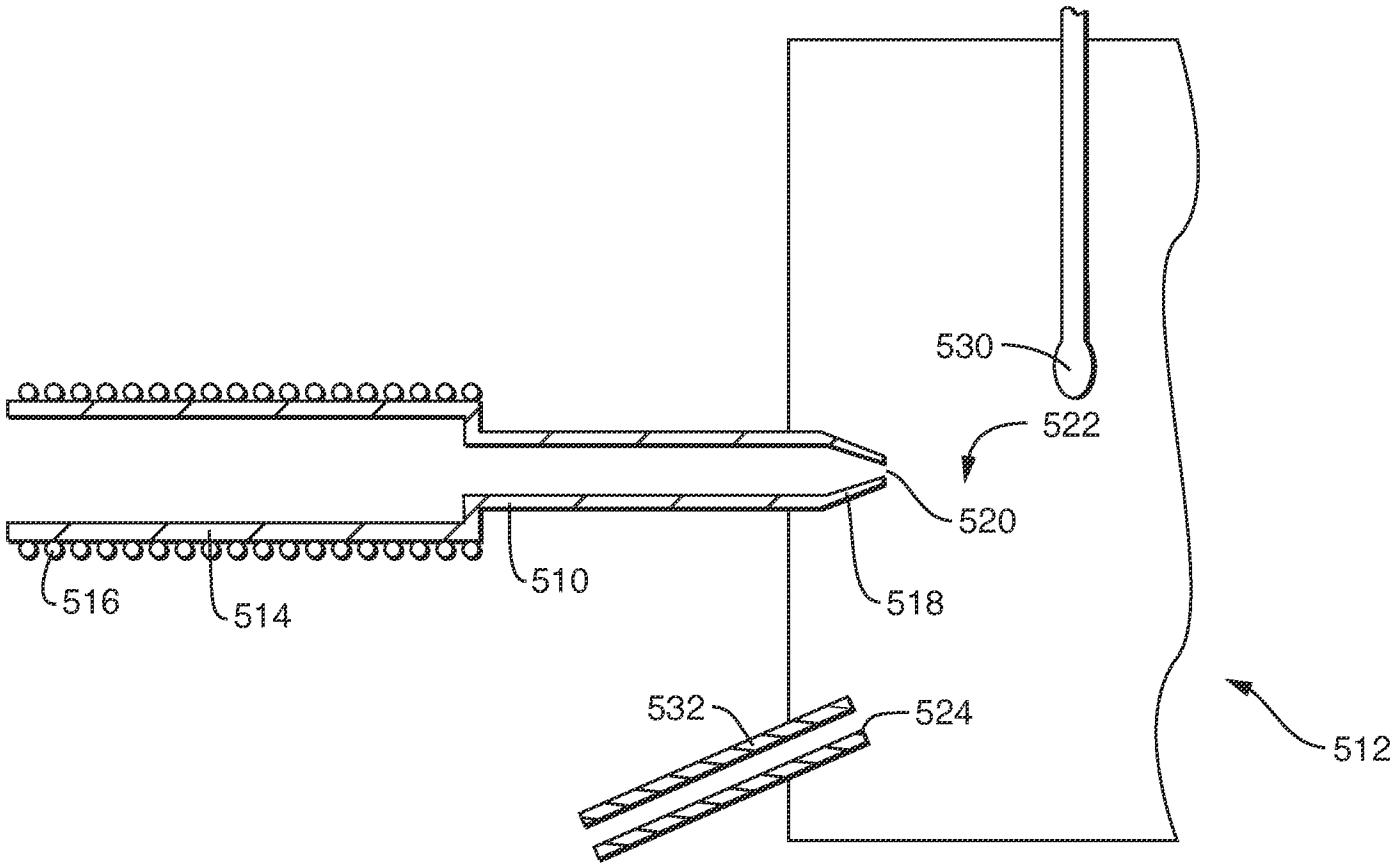
FIG. 5 is a schematic illustration of an apparatus in a fifth embodiment of the invention.

FIG. 5 is a schematic illustration of an apparatus in accordance with a fifth embodiment of the invention. In this embodiment, a supply mechanism (510) from a carbon-dioxide based chromatography device (not shown) to an ion source (512) is provided. A first conduit (514) for receiving eluent from the carbon-dioxide based chromatography device (not shown) is provided. The conduit has a heating element (516) for heating the first conduit section. A second conduit section is also provided (518), where the diameter of the second conduit section is smaller than the diameter of the first conduit section in at least one position. For example, the second conduit can be of a smaller diameter than the first diameter of the first conduit along at least a portion of a length of the second conduit. The portion of the second conduit having a smaller diameter can be disposed at or near a terminal end of the second conduit or along the length of the conduit. In exemplary embodiments, the second conduit can have a tapered portion, a converging-diverging portion, or other reduced-diameter portion.

Following the second conduit system, an inlet (520) is provided for receiving eluent from the second conduit section (518) and spraying the eluent from the inlet (520) into an ion source region (522) to form a plume of gas and/or liquid in the ion source region (522). An ionization promoting inlet (524) suitable for injecting an ionization promoting fluid into the ion source is also provided. In this embodiment, the ionization promoting inlet (524) is a second, separate inlet which has an outer concentric inlet (532) arranged around it to provide a nebulizing gas to assist the spraying of the ionization promoting fluid into the ion source region. Within the ion source region (522), a corona pin (530) is arranged within the path of travel of the plume of gas and/or liquid and the ionization promoting fluid. This will lead to the ionization promoting fluid to interact with the plume of gas and/or liquid to produce enhanced ionization of the eluent, upon interaction with the corona pin by the plume of gas and/or liquid and the ionization promoting fluid.

Figure 6:
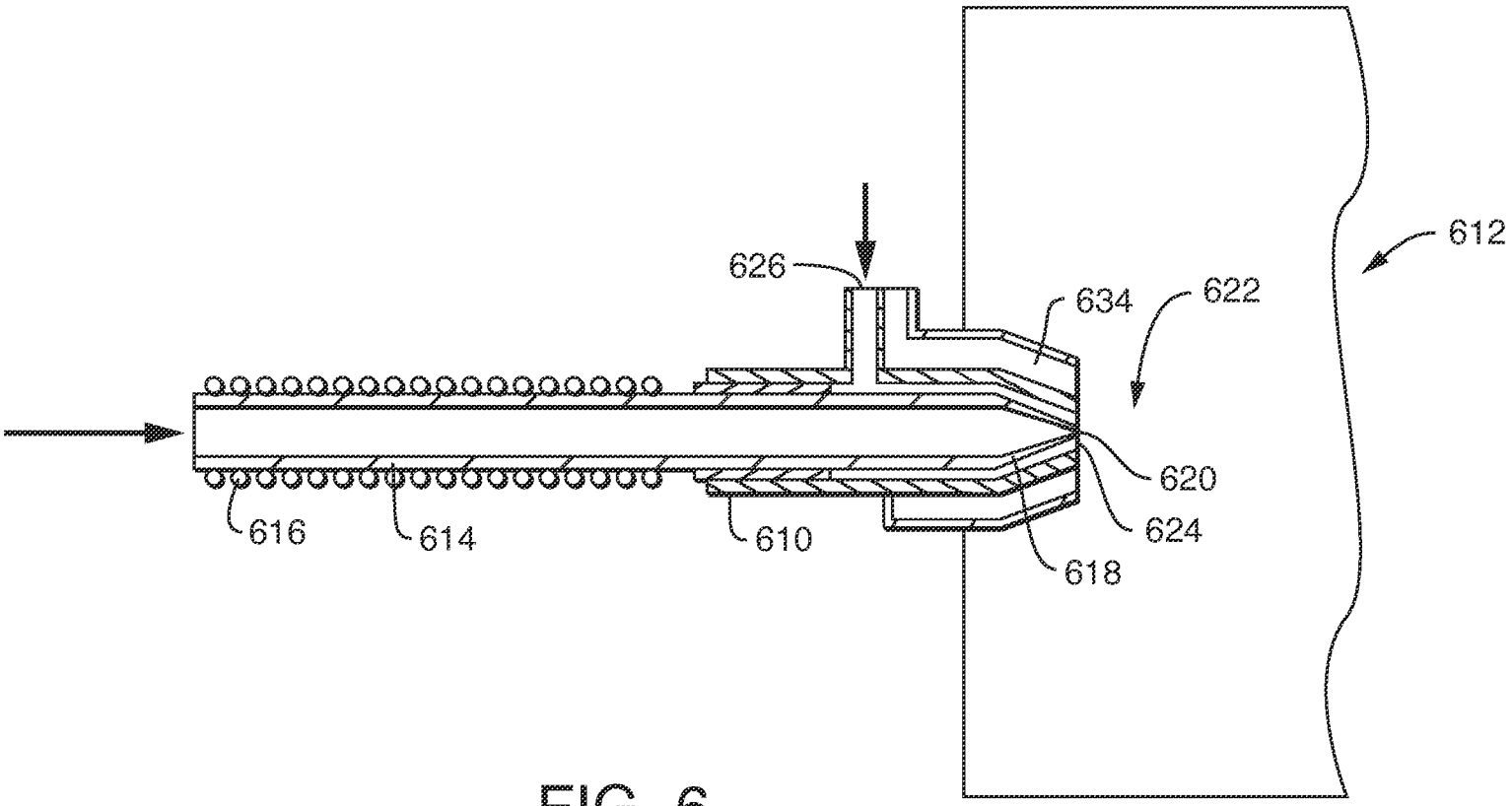
FIG. 6 is a schematic illustration of an apparatus in a sixth embodiment of the invention.

FIG. 6 is a schematic illustration of an apparatus in accordance with a sixth embodiment of the invention. In this embodiment, a supply mechanism (610) from a carbon-dioxide based chromatography device (not shown) to an ion source (612) is provided. A first conduit (614) for receiving eluent from the carbon-dioxide based chromatography device (not shown) is provided. The conduit has a heating element (616) for heating the first conduit section. A second conduit section is also provided (618), where the diameter of the second conduit section is smaller than the diameter of the first conduit section in at least one position. For example, the second conduit can be of a smaller diameter than the first diameter of the first conduit along at least a portion of a length of the second conduit. The portion of the second conduit having a smaller diameter can be disposed at or near a terminal end of the second conduit or along the length of the conduit. In exemplary embodiments, the second conduit can have a tapered portion, a converging-diverging portion, or other reduced-diameter portion.

Following the second conduit system, an inlet is provided (620) for receiving eluent from the second conduit section (618) and spraying the eluent from the inlet (620) into an ion source region (622) to form a plume of gas and/or liquid in the ion source region (622). An electrode is also provided on the needle to produce ionization. An ionization promoting inlet (624) suitable for injecting an ionization promoting fluid into the ion source is also provided. In this embodiment, the ionization promoting inlet (624) is a concentric inlet around the inlet (620). The ionization promoting fluid may be arranged to flow into the inlet through an aperture (626). The ionization promoting inlet has a further outer concentric inlet (634) arranged around it to provide a nebulizing gas to assist the spraying of the ionization promoting fluid and the eluent into the ion source region (622). The ionization promoting fluid is arranged to enter the ion source region (622) to interact with the plume of gas and/or liquid to produce enhanced ionization of the eluent.

The nebulizer gas flow is an optional feature of the invention. In some embodiments, where there may be a flow rate of eluent sufficiently large, the nebulizer gas flow may be required. The gas flow may be provided in any embodiments of the invention to assist, where appropriate, the spraying of, the eluent, the ionization promoting fluid or both.

A second, separate sprayer (524) of the ionization promoting fluid (as shown in FIG. 5) is an optional feature of the invention which may be provided for use with the ion sources of any of FIGS. 1-4. The nebulizing gas flow can assist the spraying of the ionization promoting fluid from a second sprayer.

The first conduit can be a tube. The first conduit can, for example, be made out of a thermally conductive material. Examples of materials suitable for use as the first conduit are stainless steel, diffusion bonded titanium microfluidic devices and ceramic materials (e.g. $Al_2O_3$). In other embodiments the first conduit may be made out of a thermally non-conductive material. In these embodiments, Examples of materials suitable for use as the first conduit are fused silica, PEEK, polyimide, and other plastics. The tubing can have an inner diameter in the range of about 10 μm to about 1 mm.

The heating element can be a filament surrounding the first conduit section. Any known heating system may be used to heat the conduit section. Examples of other heating arrangements suitable include a flat heater adhered to the conduit, heating elements upon the conduit surface, which are particularly useful where the conduit is ceramic. In some embodiments a temperature sensor may be provided. In some embodiments a temperature feedback circuit may be provided in order to regulate the temperature of the eluent within the conduit. The temperature sensor can be provided in the first conduit section. In other embodiments, the temperature sensor may be provided in the second conduit section.

In some embodiments, there may be a pressure sensor arranged within the conduit. The pressure sensor would preferably be arranged to have a low internal volume. In some embodiments the pressure sensor may be arranged after the chromatography device with a mobile phase comprising carbon dioxide, but before the heated first conduit section.

For example, a temperature controller can optionally be in communication with the temperature sensor to determine the current temperature of the eluent in the first or second conduit and, if necessary, adjust the temperature applied to the heated region in order to attain a target pressure. A predetermined mapping of temperature to pressure, can be used to determine the necessary temperature adjustment. In another embodiment, the temperature controller can include an active feedback loop with a pressure sensor disposed in the fluidic path for closed-loop control. For example, the temperature and/or pressure can be controlled as discussed in U.S. Provisional Patent Application No. 61/777,065, filed Mar. 12, 2013, which is incorporated by reference herein in its entirety.

The second conduit section can be a tube. The second conduit may be made out of a conductive material. Examples of conductive materials suitable for use as the second conduit are stainless steel, diffusion bonded titanium microfluidic devices and ceramic materials (e.g. $Al_2O_3$). In other embodiments the second conduit may be made out of a non-conductive material. In these embodiments, examples of materials suitable for use as the first conduit are fused silica, PEEK, polyimide, and other plastics. Preferably at least part of the conduit is of a size in the range of about 100 nm to about 0.1 mm I.D. The tubing may be a length of straight, small I.D. tubing, a tapered restrictor, a converging-diverging restrictor, an integral restrictor, or a fritted restrictor.

The second conduit can be connected directly to a sprayer, which is arranged to spray the eluent into an ion source region. The sprayer may be any type of known sprayer. In some embodiments, further tubing may be arranged between the second conduit section and the sprayer.

The ion source region can be at substantially atmospheric pressure, although in some embodiments the ion source region could be operated at pressures lower than atmospheric pressure or higher than atmospheric pressure.

In an exemplary embodiment the ionization promoting fluid can be methanol. In other embodiments, the ionization promoting fluid may be acetonitrile, isopropanol, ethanol, methanolic ammonia, methanolic hydrochloric acid, tetrahydrofuran, alkanes (e.g. hexane, heptane, etc.), chlorinated solvents (e.g. chloroform, chloromethane, dichloromethane etc.) and/or mixtures of these solvents. In some embodiments, the ionization promoting fluid may be supplemented by an additive. Examples of suitable additives may include <1% water, trifluoroacetic acid, methylamine, diethylamine, triethylamine, ammonium acetate, ammonium formate, <1% phosphoric acid, formic acid, formaldehyde, organic acids (oxalic, citric, etc), ≥1% water and ≥1% phosphoric acid. In one embodiment the ionization promoting fluid may be methanol with about 0-10% water and about 0.1% formic acid. In a further embodiment the ionization promoting fluid may be isopropanol with about 0-50% water and about 0.1% formic acid.

In some $CO_2$ based chromatography systems, a makeup fluid can be introduced downstream of the column, before the flow stream is split into the MS. The fluid can be methanol with up to about 5% water and about 0.5% of an ionization enhancer (e.g., formic acid or ammonium hydroxide, etc.). Since ESI relies on droplet formation to produce ions, this makeup fluid is required for ionization while operating $CO_2$ based chromatography systems with low modifier percentages due to the lack of liquid around to form droplets. This makeup flow introduction can require a tee fitting in the analyte flow stream which can have a detrimental effect on peak fidelity. In some cases, this can be about a 30% decrease in observed chromatographic efficiency.

In embodiments disclosed herein, the restrictor can be used to introduce the full flow of the column to the mass spectrometer ion source.

Similarly, in some embodiments, liquid can be necessary for efficient ionization in the impactor spray embodiments while operating $CO_2$ based chromatography systems with low modifier percentages. Even if ionization occurs at low modifier percentages without makeup flow in impactor spray, an ionization enhancer can be introduced to increase the response in the source.

In embodiments disclosed herein, a makeup flow can be added to the eluent flow upstream of the restrictor.

Embodiments disclosed herein can preserve the peak fidelity by introducing the eluent according to the described systems, devices, and methods without including a makeup flow.

The ion source can be Impactor Spray, APCI, APPI, Electrospray, ESCI, or any other known type of ion source with minor alterations to the arrangement.

In the embodiment relating to an impactor spray ion source, a frit or grid element may be interchanged for the impactor surface as described and depicted in the embodiments of FIGS. 2 and 4.

One of ordinary skill in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. An ion source, for connecting a carbon-dioxide based chromatography device to a mass spectrometer, comprising:

a first conduit for receiving eluent from the chromatography device, the first conduit having a first diameter, a heater for heating at least a portion of said first conduit, a second conduit in fluid communication with the first conduit for receiving eluent flowing from the first conduit, the second conduit having a smaller diameter than the first diameter of the first conduit along at least a portion of a length of the second conduit, an inlet for receiving eluent from said second conduit and introducing the eluent into an ion source region to form a plume of gas and/or liquid in the ion source region; and an ionization promoting inlet for injecting an ionization promoting fluid into the ion source region to interact with the plume to promote ionization of at least some of the plume.

2. The ion source of claim 1 wherein said ion source is an electrospray ion source.

3. The ion source of claim 2 wherein said ionization promoting inlet is concentric to the inlet needle.

4. The ion source of claim 1 wherein said ion source is an impactor spray ion source.

5. The ion source of claim 4 wherein the impactor spray ion source having an impactor, where the ionization promoting inlet is a hole disposed on the impactor.

6. The ion source of claim 1 wherein said ion source is an APCI ion source.

7. The ion source of claim 1 wherein the second conduit is a conduit of constant diameter.

8. The ion source of claim 1 wherein the second conduit is a tapered conduit.

9. The ion source of claim 1 wherein the second conduit includes a fritted restrictor.

10. The ion source of claim 1 wherein the second conduit includes a converging-diverging restrictor.

11. The ion source of claim 1 wherein the second conduit includes an integral restrictor.

12. The ion source of claim 1 wherein the ionization promoting inlet is adapted to facilitate the ionization promoting fluid containing methanol.

13. The ion source of claim 1 wherein the ionization promoting inlet is adapted to facilitate the ionization promoting fluid contains a liquid selected from the group consisting of acetonitrile, isopropanol, ethanol, methanolic ammonia, methanolic hydrochloric acid, tetrahydrofuran, alkanes, and chlorinated solvents.

14. The ion source of claim 1 further comprising a temperature sensor and feedback mechanism, for regulating the temperature of the eluent passing from the carbon-dioxide based chromatography device into the ion source region.

15. The ion source of claim 1 further comprising a pressure sensor and feedback mechanism, for regulating the pressure of the eluent passing from the carbon-dioxide based chromatography device into the ion source region.

16. The ion source of claim 1 wherein the ion source includes a make up flow.

17. A mass spectrometer incorporating an ion source as claimed in claim 1.

18. A retrofit kit for adapting a mass spectrometer incorporating an ion source as claimed in claim 1.

19. A carbon-dioxide based chromatography device and a mass spectrometer incorporating an ion source as claimed in claim 1.

20. A retrofit kit for adapting a carbon-dioxide based chromatography device and a mass spectrometer incorporating an ion source as claimed in claim 1.

21. A method of ionizing analytes of interest within an eluent using an apparatus as described in claim 1.

22. A method of connecting a carbon-dioxide based chromatography device to a mass spectrometer and ionizing analytes of interest within an eluent comprising:

receiving eluent from carbon-dioxide based chromatography device in a first conduit having a first diameter, heating at least a portion of said first conduit, receiving the eluent from the first conduit in a second conduit having a smaller diameter than the first diameter of the first conduit along at least a portion of the length of the second conduit, injecting the eluent in the second conduit from an inlet into an ion source region to form a plume of gas and/or liquid in the ion source region;

injecting an ionization promoting fluid into the ion source region to interact with the plume of gas and/or liquid to produce enhanced ionization of at least some of the plume of gas and/or liquid.

23. The method of claim 22, wherein the method further comprises measuring the temperature of the eluent in the first conduit or the second conduit using a temperature sensor.

24. The method of claim 23, further comprising adjusting the temperature of the eluent according to the temperature measured by the temperature sensor to optimize ionization.

25. The method of claim 22, wherein the method further measuring the pressure of the eluent in the first conduit or the second conduit using a pressure sensor.

26. The method of claim 25, further comprising adjusting the pressure of the eluent according to the pressure measured by the pressure sensor to optimize ionization.

27. The ion source of claim 1, wherein the eluent from the carbon-dioxide based chromatography device has a mobile phase comprising carbon-dioxide.

28. The ion source of claim 27, wherein the carbon-dioxide mobile phase has a modifier percentage below about 5%.

29. The ion source of claim 1, wherein the carbon-dioxide based chromatography device is a supercritical fluid chromatography system utilizing carbon-dioxide in a mobile phase flow stream.

30. The method of claim 22, wherein the eluent from the carbon-dioxide based chromatography device has a mobile phase comprising carbon-dioxide.

31. The method of claim 29, wherein the carbon-dioxide mobile phase has a modifier percentage below about 5%.

32. The method of claim 22, wherein the carbon-dioxide based chromatography device is a supercritical fluid chromatography system utilizing carbon-dioxide in a mobile phase flow stream.

33. The ion source of claim 1, wherein the first conduit, the second conduit, and the eluent inlet are coaxially aligned.

34. The method of claim 22, wherein the first conduit, the second conduit, and the eluent inlet are coaxially aligned.

* * * * *